US006443341B1

(12) United States Patent
Rittmann

(10) Patent No.: US 6,443,341 B1
(45) Date of Patent: Sep. 3, 2002

(54) WRIST WALLET WITH HOOK-TO-MESH-FABRIC ATTACHING MEANS

(76) Inventor: Jean V. Rittmann, 4700 176th St. SW., Apt A303, Lynnwood, WA (US) 98037

( * ) Notice: Subject to any disclaimer, the term of this patent is extended or adjusted under 35 U.S.C. 154(b) by 0 days.

(21) Appl. No.: 09/584,418

(22) Filed: Jun. 2, 2000

(51) Int. Cl.[7] ..... A45F 3/00

(52) U.S. Cl. ..... 224/219; 150/149; D3/226

(58) Field of Search ..... 224/219, 221, 224/267; D3/226, 227; 150/147, 149

(56) References Cited

U.S. PATENT DOCUMENTS

| | | | | | |
|---|---|---|---|---|---|
| 3,942,693 | A | | 3/1976 | Nashua | 224/28 B |
| D249,592 | S | | 9/1978 | Libonati | D87/3 |
| D255,509 | S | | 6/1980 | Nathan | D3/39 |
| 4,414,719 | A | | 11/1983 | Capolupo | 24/265 WS |
| 4,601,418 | A | | 7/1986 | Gruzensky | 224/222 |
| 4,763,821 | A | | 8/1988 | Powell | 224/267 |
| 4,958,279 | A | | 9/1990 | Proellochs | 368/282 |
| 5,004,197 | A | * | 4/1991 | Weekley | 248/188.9 |
| 5,012,963 | A | * | 5/1991 | Rosenbaum | 224/42.46 R |
| D329,021 | S | | 9/1992 | Robbins | D10/31 |
| D329,201 | S | | 9/1992 | Barat | D10/31 |
| D339,472 | S | | 9/1993 | Parker | D3/100 |
| D347,733 | S | | 6/1994 | Miller | D3/226 |
| 5,341,972 | A | | 8/1994 | Jacks | 224/165 |
| 5,358,471 | A | | 10/1994 | Klotz | 602/21 |
| D352,824 | S | * | 11/1994 | Saggese, Jr. | D3/226 |
| D358,705 | S | * | 5/1995 | Saggese, Jr. | D3/226 |
| D371,675 | S | | 7/1996 | Carter | D3/215 |
| D373,900 | S | | 9/1996 | Montgomery | D3/226 |
| 5,588,571 | A | | 12/1996 | Mazzo | 224/222 |
| 5,671,481 | A | | 9/1997 | Giard | 2/170 |
| 5,749,841 | A | | 5/1998 | Moore | 602/21 |
| 5,836,488 | A | * | 11/1998 | Priestley | 224/222 |
| D404,908 | S | | 2/1999 | Lollis | D3/215 |
| 6,227,424 | B1 | * | 5/2001 | Roegner | 224/219 |

* cited by examiner

*Primary Examiner*—Stephen P. Garbe

(57) ABSTRACT

The invention is a wrist wallet, substantially made of mesh fabric, having laterally positioned first pocket (50*a*), second pocket, and third pocket. A lining is inside the third pocket. All pockets have a single laterally elongated sealing element at the top of the wallet in the form of a zipper having teeth (39*a*). The wallet has an attaching means that secures the wallet circumferentially about a wearer's wrist. The attaching means is hooks and eyes, the eyes being mesh fabric.

4 Claims, 2 Drawing Sheets

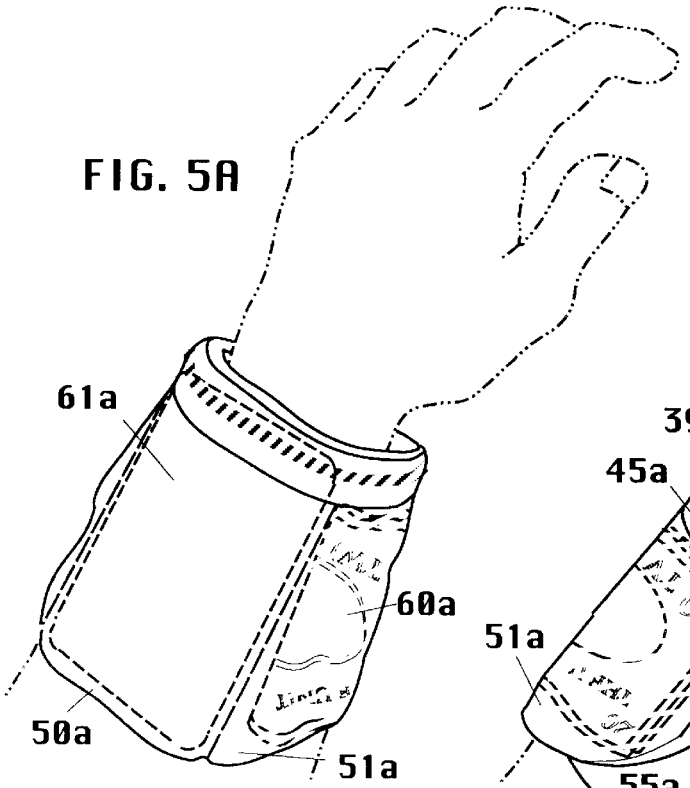
FIG. 5A
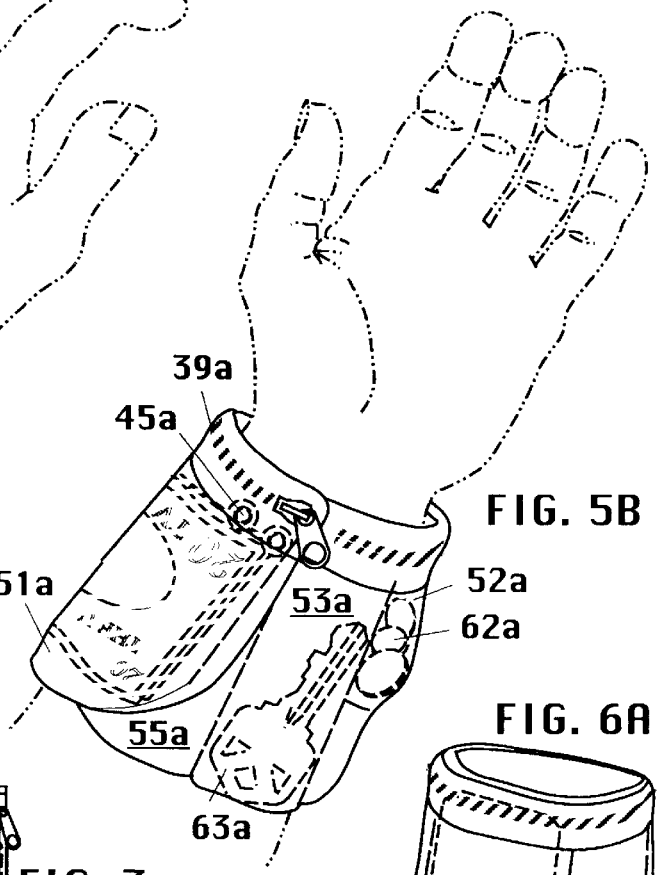
FIG. 5B
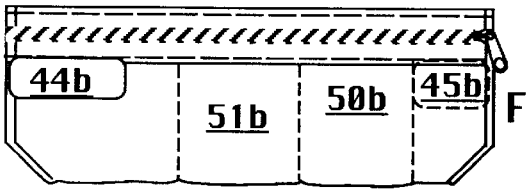
FIG. 3
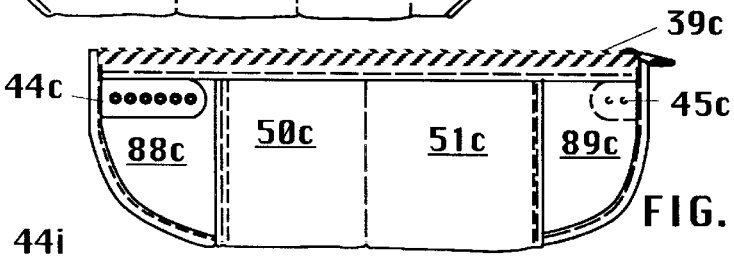
FIG. 8
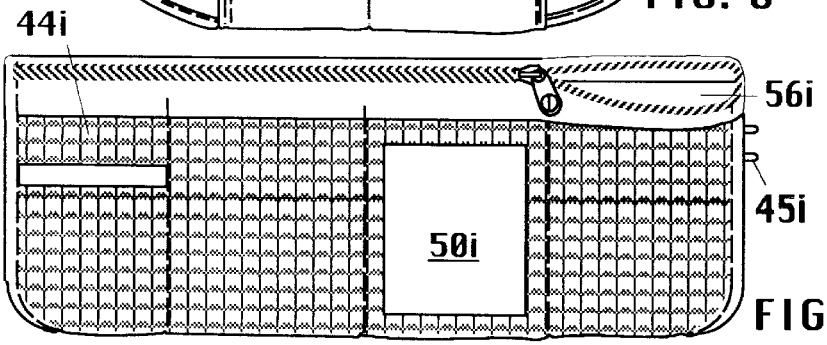
FIG. 7
FIG. 6A
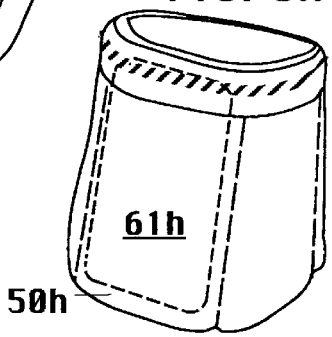
FIG. 6B
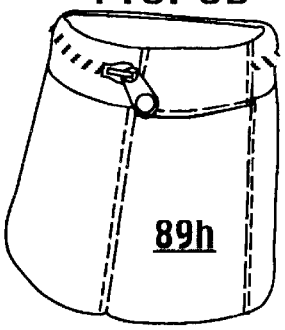

WRIST WALLET WITH HOOK-TO-MESH-FABRIC ATTACHING MEANS

CROSS-REFERENCE TO RELATED APPLICATIONS

Not applicable.

STATEMENT REG. FED. SPONSORED R. OR D.

Not applicable.

REFERENCE TO A MICROFICHE APPENDIX

Not applicable.

BACKGROUND OF INVENTION

This invention relates to Package and Article containers, carried by an animate bearer, held by receiver, with attaching means extending circumferentially of limb.

Prior wrist wallets can be multi-layered or bulky, and often must be taken off to access contents, or have multiple straps to attach.

Plastic cards ≈8.5×5.4 cm (3.4"×2.1"), like driver's licenses, credit cards, insurance cards, etc. are carried by most adults in the U.S, and often require more access than cash. Many wrist wallets are not sized to contain such cards, let alone make them easy to access. Most wallets are designed for flexible dollar bills, and small items like coins, and keys; not rigid plastic cards. None allow cards to position in a manner of benefit to the wearer.

Prior art U.S. Pat. No. 5,341,972. by R. Benton Jacks, granted Aug. 30, 1994, entitled WRIST WATCH AND WALLET, must be removed from the wrist to access contents. Per P. 5, line 43–45, horizontally elongated "pocket 56 . . . designed to carry smaller objects, such as coin currency or medications". Prior design art U.S. Pat. No. D371,675 by Russell J. Carter, granted July 16, 1996, entitled WRIST WALLET, is a purse-like style wrist wallet, with pockets overlaying each other, that position on the anterior wrist, which restricts wrist bending and rubs against the palm. Prior design art U.S. Pat. No. D373,900 by John T. Montgomery Sr., granted Sept. 24, 1996, entitled WRIST WALLET WITH POCKET and prior art U.S. Pat. No. 5,671,481 by B. Joan Giard, granted Sept. 30, 1997, entitled, FOLDING SWEATBAND WITH INTERIOR COMPARTMENT, are width folded wallets, resulting in thick, narrow wristbands. The fold of dollar bills is quite stiff. The bill's folded stiffness in such wallets keeps them from circling a wrist smoothly.

Prior design-patent art U.S. Pat. No. D249,592 by Michael R. Libonati, granted Sept. 19, 1978, entitled FOREARM CARRYALL (likely designed for the forearm, not wrist), shows a single flat pocket design attached by two encircling straps, where the zipper would position parallel with a wearer's forearm. Because the zipper positions downward and inward from the edges: the pocket would need to be very large (2.7"×4.7") to insert/remove a plastic card from this design: This would be an awkwardly large size on a wearer if worn near the wrist. Even a stretchy pocket would need to be this large because the nonstretchy zipper opening limits the pocket width.

BRIEF SUMMARY OF THE INVENTION

The invention can be a wallet with a pocket of a. size & shape to contain/support plastic cards on the posterior wrist. The long sides of the cards position parallel with the length of the wearers forearm. The wallet can have. several lateral pockets to contain/separate bills, checks, coins, keys, etc. The pockets can have a lateral opening means (zipper) and a wrist-encircling securing means (like snaps, elastic, Velcro@ or hooks).

ADVANTAGES OF THE INVENTION

The wrist wallet provides a pocket for conveniently holding plastic cards. It makes their rigid bulk barely noticeable. It can hold bulky, heavy contents. It keeps all items, like the stiff cards, away from the anterior wrist, so the wrist can freely bend. Plastic cards, and other items, can be easily accessed without, taking the wallet off. The wallet flatly contains and separates plastic cards, bills, checks, coins, keys, etc. into several lateral pockets. This separating distributes wallet bulk evenly about the wearer's wrist. Coins don't shift around in its wrist-curved pockets. Contents can be accessed/inserted while the wallet is worn, so the wallet is safe and convenient. A zipper closure allows partial opening and easy access to all pockets when desired. The wallet's flat construction is not bulky. Using only top attachment means lets the wallet's lower portion expand to different forearm widths.

The wrist is a safe, convenient location to keep cash and cards. One can be assured it is there at a glance. Unlike a pocket wallet: it does not need a pants pocket, it's harder to pick-pocket, and it won't fall out doing sports. Unlike an ankle wallet, it does not restrict running activity and one does not have to bend. over to access it. It is safer and easier to find than a wallet in a purse. [Pocketbooks can be unsafe, as they are large and often set down in a grocery cart or hung loose at one's side in a crowd.]

BRIEF DESCRIPTION OF THE DRAWINGS

FIG. 3 is a wallet embodiment with alternative parts, front view.

FIG. 5 is FIG. 4 on a wearer; A: posterior view B: anterior view

FIG. 6 a round wallet embodiment; A: posterior view B: anterior view

FIG. 7 is a wallet embodiment with mesh fabric, front view.

FIG. 8 is a wallet embodiment with alternative parts, front view.

DESCRIPTION OF THE NOTATIONS

Figure 2:
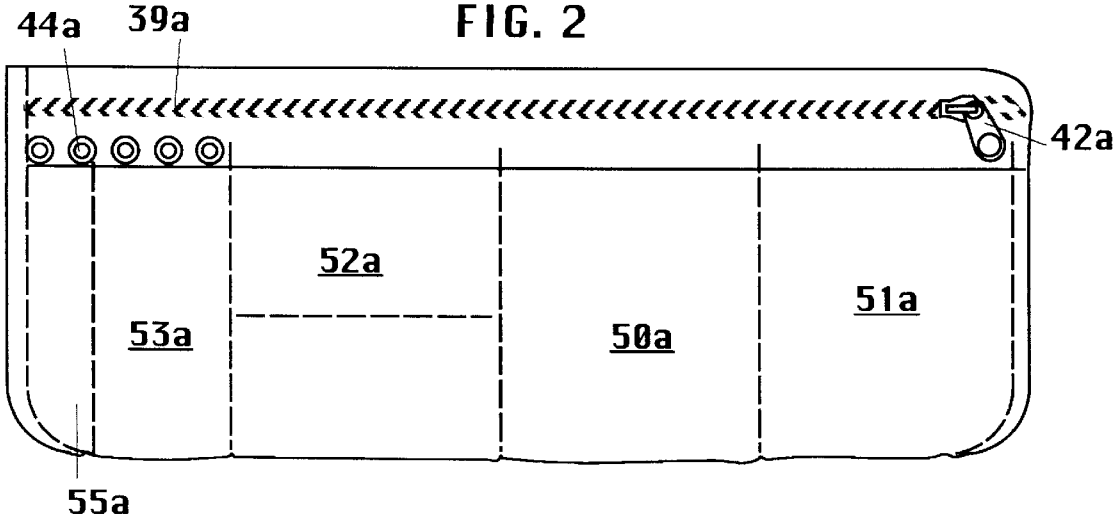
FIG. 2 is a wallet embodiment with front zipper, front view.

39 prior art zipper teeth
42 prior art zipper pull
50 is a first pocket
51 is a second pocket
52 is a third pocket
53 is a fourth pocket
55 is a fifth pocket
56 is a pocket lining
60 prior art folded bill(s)
61 prior art plastic card(s)
62 prior art coins
63 prior art key(s)

64 prior art small pen
87 prior art backing material
88 prior art mesh fabric
89 prior art elastic
notations a, b, c, h, and i show same part in different embodiments

DETAILED DESCRIPTION OF THE INVENTION

Description of One Embodiment of the Invention

FIG. 2 shows a wallet embodiment, layed flat, front view. The wallet has lateral width and vertical height. Its width is of a size and shape to encircle a wearer's wrist. The height is of a size and shape to extend a parallel length to a wearer's forearm. Stitching on this and other embodiments is shown as long dashed lines. Wrist-encircling attaching means are side A snap sockets 45*a* snapped to side B snap studs 44*a* (attached to fabric rear section). Snaps attached to the strong zipper backing deters fabric tearing when snaps are pulled apart. A horizontally elongated zipper is the pocket sealing means. Prior art zipper teeth 39*a* position high on the pockets so items can be pulled out easily without lifting the top half of the pocket off the card's short edge. Noted are first, second, third, fourth, & fifth pockets 50*a*, 51*a*, 52*a*, 53*a*, and 55*a* respectively; and prior art zipper pull 42*a*.

Figure 1:
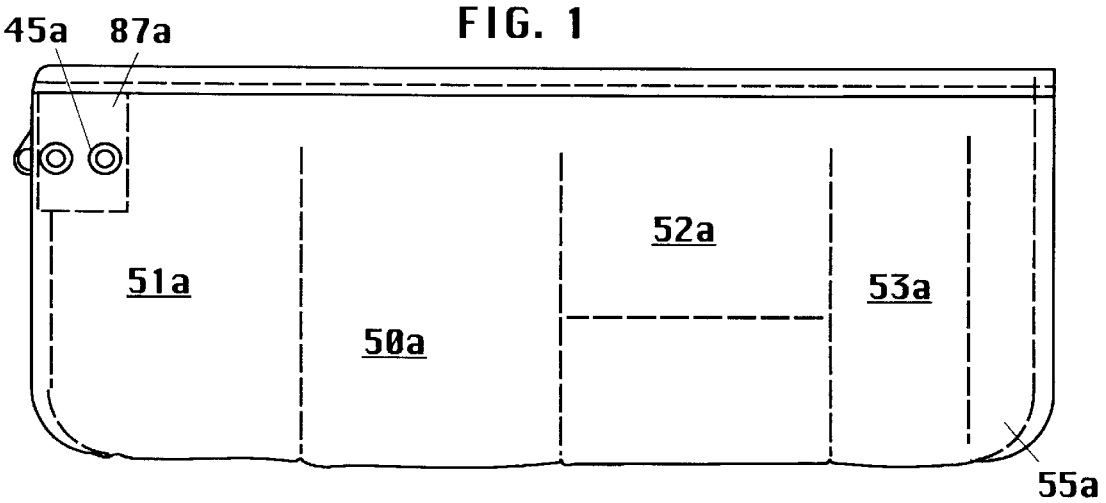
FIG. 1 is a wallet embodiment with front zipper, rear view.

FIG. 1 shows the embodiment of FIG. 2, rear view. Backing material 87*a*, when applied, keeps snap studs 45*a* from tearing fabric when pulled. First, second, third, fourth, and fifth pockets 50*a*, 51*a*, 52*a*, 53*a*, and 55*a* are noted respectively. The rear fabric and front fabric (shown in FIG. 2) can be made from one continuous piece of fabric.

Figure 4:
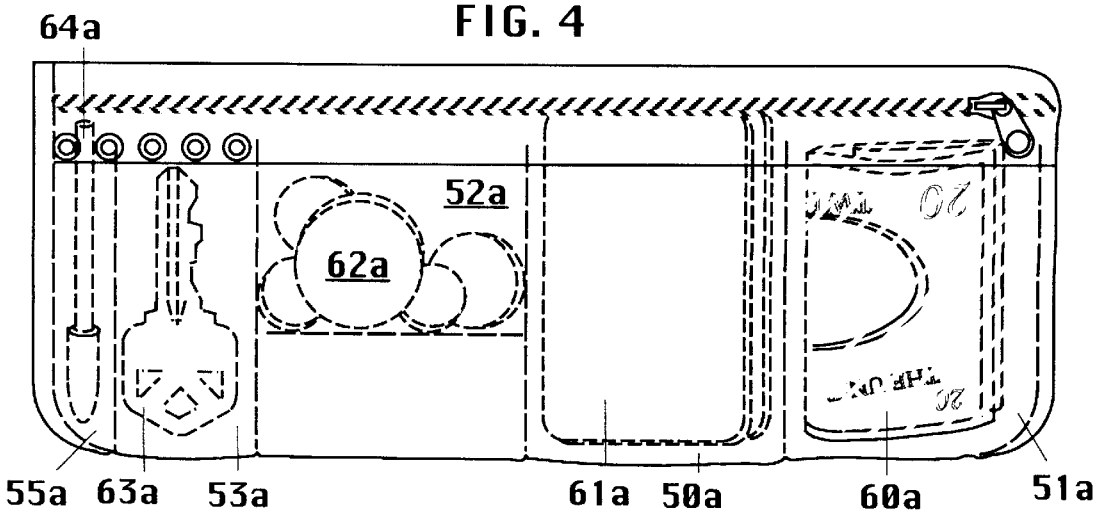
FIG. 4 is the embodiment of FIG. 2 with contents inside, front view.

FIG. 4 is the embodiment of FIG. 2 with contents (prior art items) inside, front view. Prior art: plastic card(s) 61*a*, tri-folded bill(s) 60*a*, coin(s) 62*a*, key 63*a*, and small pen 64*a* are shown in pockets 50*a*, 51*a*, 52*a*, 53*a* and 55*a* respectively. Contents may be arranged in the pockets as desired. First pocket 50*a* positions lateral to second pocket 51*a*. The first pocket has a pair of vertical sides, and is of a size and shape to fixedly confine plastic cards, like cards 61*a*. When such cards are contained, their longer sides position parallel to the vertical sides of the pocket. The straight design of the embodiment can allow one to use the wallet as a regular billfold wallet (like a tri-fold).

One Embodiment of the Invention on a Wearer

FIG. 5A is the embodiment of FIG. 4 worn on a wearer, medial posterior perspective view of the wearer's hand and wrist. The plastic cards 61*a*are placed flat with the back of the wrist (in first pocket 50*a*). As soft fabric, the edges of the first pocket (holding the cards) conform around the wearer's wrist (vs. poking out like in Libonati's patent). The 5.4 cm width of plastic cards is approximately the width of an adult-sized wrist. The cards position well on a wearer's wrist with their 8.5 cm length parallel with the length of a wearer's forearm.

Prior art folded bill(s) (see item 60*a* in FIG. 1) may be in second pocket 51*a*. Plastic cards (often slippery) can be easily pulled-from/put-in first pocket 50*a* (especially when at least one card is left in the wallet). Folded bills are also convenient when placed in this pocket.

FIG. 5B is the embodiment of FIG. 1 worn on a wearer, anterior perspective view of the wearer's hand/wrist. The shiftable weight of heavy items like coins 62*a*, in pocket 52*a*, are restrained by the pocket continuing around the wrist. Coins can be accessed while the wallet is worn by tilting the hand down. Placing coins in pocket 51*a* would provide similar coin restraint (positioned on the other side of the wrist). Key 63*a* (or other things like lipstick) can position in fourth pocket 53*a*. The overlap of pocket 52*a* over pocket 55*a* keeps the weight of the key from dangling loose (which is more possible when placing weight on an unsecured bottom end of a pocket). The zipper pull positions on top, not under, the overlapping edges of the wallet to let the pockets be opened while worn. Zipper teeth 39*a* are near the top of the wallet (near the hand) to allow easy unzipping when worn, and to keep contents from falling out of unzipped pockets when the hand faces up. When the hand faces down, the bulk, or wider diameter of the hand keeps the wallet from slipping off the arm. Pockets 51*a* and 55*a* have unsecured bottom end edges. This (and/or using stretch fabric) lets these bottom edges spread wider to accommodate the widening diameter of a wearer's forearm, as well as more contents.

Other Wallet Embodiments of the Invention

FIG. 6 is a round, tube-like wallet embodiment, such that when worn; A is the posterior perspective view and B is the anterior perspective view. Plastic card(s) 61*h* position on the wearer's posterior wrist when worn. The attaching means is wide elastic 89*h*. Wallet elastic 89*h* can be laterally stretched (an extra 1.5"+) so the wallet can slip over the (wider diameter) hand to remove/place it on the wrist. [This elastic is needed as the zipper's length is not stretchable].

FIG. 7 is a wallet embodiment with alternative parts, front view. All the zipper back is on the front side of the wallet. The attaching means is B side hook tape 45*b* and A side loop tape 44*b* (like Velcro®). This embodiment has four pockets, where a larger pocket is under the loop tape. This larger pocket is of a size to place many once-folded-lengthwise bills. The fold of the bills may be vertically parallel with the wearer's forearm, where the stiff fold. of the bills will not interfere with wrapping the wallet smoothly around the wrist. Second pocket 51*b* is to the left of first pocket 50*b*. When plastic cards are placed in pocket 50*b*, hook-side tape 40*b* positions more medially on the wrist than the previous embodiment.

FIG. 8 is a wallet embodiment with alternative parts, front view. It has two pockets: first pocket 50*c* and second pocket 51*c*. Prior-art elastic 89*c* can add lateral stretch/give. Prior art heavy-duty (single layer) mesh fabric 88*c* can help aerate a wrist. Zipper teeth 39*c* position on the top edge of the embodiment, and can be of a prior/future art design similar to zipper seals on plastic food baggies. Attaching means is prior art plastic molded strip snap studs (side B) 45*c* and sockets (side A) 44*c*; like snaps used on baseball caps. Bias tape is shown sewn on the lateral edges.

FIG. 7 is a wallet embodiment with mesh fabric, front view. It's hooks 45*i* is attaching means side B, like brassiere-back hooks & eyes. The heavy-duty) mesh fabric itself at section 44*i* is used as the 'eyes' of the hook & eye as attaching (side A) is unique to the invention. The bra hooks do not just slide into, but lock onto the mesh. A rectangular label, directly below 44*i*, is used as a guide so a wearer hooks to a proper area of the mesh. Pocket lining (like lining 54*i*) can be used inside any mesh pocket to smooth insertion of bills (mesh can catch edges of bills). Pocket 50*i* has a label sewn on over the mesh fabric to conceal information on plastic cards. Other pockets can have labels.

Each of these wristwallet embodiments include a wallet sealing means (like a zipper), and a wallet attaching means, like snaps, hooks & eyes, elastic, or Velcro®.

Versions of the Wallet Invention Not Shown

A mirror-image of embodiments shown can be made, like for left-handed wearers. An embodiment can position the zipper pull under overlapping edges. The sides of mating attachment means (like snap sockets/studs) may be exchanged. Other pocket arrangements, sizes and shapes may be used. The sealing means can also be snaps, hook and loop tape or other.

Materials and Dimensions

Wallet dimensions may be, but is not limited to being: height 3.7"; encircling width/zipper length about 10"; thickness about 0.1"(two layers of fabric); and first pocket about 3.7"×2.5". First pocket 50 is large enough to contain one or more plastic ≅8.5 cm×5.4 cm cards. The pocket may be larger or smaller than this (i.e. smaller if the fabric, used to form the pocket is very stretchy, like Lycra®). A soft pocket is one that is not stiff enough by itself to provide a rigid surface. Fabrics to make pockets/ linings include, but are not limited to: knits, weaves, mesh, Lycra®, ribbon, plastic sheeting, and/or others.

I claim:

1. A wrist wallet, said wallet having lateral width, vertical height, and a top edge;

said width of a size and shape to encircle a wearer's wrist;

said wallet having a first pocket, a second pocket, and an attaching means;

said wallet being made substantially of mesh fabric;

said second pocket positioning lateral to said first pocket; further including a third pocket;

said third pocket positioning lateral to said first pocket; said third pocket having a pocket lining; said lining positioned inside said third pocket;

all said pockets having a single laterally elongated sealing means;

said sealing means positioned at said top edge of said wallet, and said sealing means being a zipper;

wherein when said wallet is worn by a wearer, said attaching means secures said wallet circumferentially about the wearer's wrist.

2. The wrist wallet of claim 1, further including a label said label attached on over said first pocket such that when plastic cards are in said first pocket, said label substantially conceals information on said cards.

3. The wrist wallet of claim 2, wherein said attaching means are hooks and eyes,said eyes being mesh fabric.

4. The wrist wallet of claim 1, wherein said attaching means are hooks and eyes, said eyes being mesh fabric.

* * * * *